US007621246B2

(12) United States Patent
Tohyama

(10) Patent No.: US 7,621,246 B2
(45) Date of Patent: Nov. 24, 2009

(54) STARTER FOR SMALL-SIZED ENGINE

(75) Inventor: Isao Tohyama, Suginami-ku (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 12/083,622

(22) PCT Filed: Aug. 2, 2006

(86) PCT No.: PCT/JP2006/315288

§ 371 (c)(1),
(2), (4) Date: Jun. 10, 2008

(87) PCT Pub. No.: WO2007/046179

PCT Pub. Date: Apr. 26, 2007

(65) Prior Publication Data

US 2009/0139480 A1 Jun. 4, 2009

(30) Foreign Application Priority Data

Oct. 17, 2005 (JP) ..... 2005-301587

(51) Int. Cl.
*F02N 3/02* (2006.01)
*F02N 5/02* (2006.01)
*F02N 11/00* (2006.01)

(52) U.S. Cl. ..... 123/179.24; 123/185.3

(58) Field of Classification Search ..... 123/179.24, 123/185.14, 185.3
See application file for complete search history.

(56) References Cited

U.S. PATENT DOCUMENTS

| | | | | |
|---|---|---|---|---|
| 4,637,360 | A * | 1/1987 | Osakabe | 123/185.3 |
| 4,922,868 | A * | 5/1990 | Ohkanda | 123/179.24 |
| 5,010,858 | A * | 4/1991 | Schierling et al. | 123/179.24 |
| 5,083,534 | A * | 1/1992 | Morishima et al. | 123/185.14 |
| 5,113,816 | A * | 5/1992 | Morishima et al. | 123/185.14 |
| 6,199,529 | B1 * | 3/2001 | Kuwabara et al. | 123/179.24 |
| 6,240,889 | B1 * | 6/2001 | Kuwabara et al. | 123/179.24 |
| 6,374,791 | B1 * | 4/2002 | Kuwabara et al. | 123/179.24 |

FOREIGN PATENT DOCUMENTS

| | | |
|---|---|---|
| JP | A-2002-227753 | 8/2002 |
| JP | A-2002-235640 | 8/2002 |
| JP | A-2002-285940 | 10/2002 |
| JP | A-2003-120488 | 4/2003 |
| JP | A-2006-329125 | 12/2006 |

* cited by examiner

*Primary Examiner*—Stephen K Cronin
*Assistant Examiner*—Arnold Castro
(74) *Attorney, Agent, or Firm*—Oliff & Berridge PLC

(57) ABSTRACT

A starter for a small-sized engine, capable of reliably starting the engine by a rope reel and stably supporting a drive cam. The starter has, received in a starter case, a cylindrical drive cam having a starter clutch mechanism, the rope reel for a recoil starter, and a starter motor, where the drive cam can be selectively operably connected to the rope reel or a starter motor. The rope reel is directly operably connected to the drive cam through a one-way clutch mechanism. Support plates are formed projected from the inner surface of the starter case toward the outer peripheral surface of the drive cam. Opposite ends of the drive cam are rotatably supportedly fitted into bearing holes formed in the support plates.

1 Claim, 4 Drawing Sheets

STARTER FOR SMALL-SIZED ENGINE

TECHNICAL FIELD

The present invention relates to a starter for a small-sized engine, including a combination of an electrically operated starter motor and a recoil starter for pulling a starter rope, used as a starter for a small-sized engine.

BACKGROUND ART

When a starting-mechanism based on a starter motor and a starting mechanism based on a rope reel are combined, it is necessary to selectively switch over from one of a transmission system based on the starter motor and a transmission system based on the rope reel to the other. Therefore, a drive cam provided so as to be capable of engaging with an engine was heretofore operably connected to a drive gear which was disposed coaxially through a force storage spiral spring as a shockless force storage unit and which was selectively operably connected through a one-way clutch mechanism to a reduction gear linked to a recoil starter rope reel wound with a starter rope or linked to a starter motor. The force storage spiral spring was disposed between the drive cam and the drive gear. In the case where the starter motor was to be rotated, force was stored in the force storage spiral spring so that the force storage spiral spring could rotate the drive cam when the energy of the force storage spiral spring reached force enough to rotate the drive cam.

Similarly, also in the case where the starter rope was pulled to rotate the rope reel, the rope reel was rotated to rotate the drive gear linked to the rope reel to thereby store force in the force storage spiral spring so that the force storage spiral spring could rotate the drive cam when the energy of the force storage spiral spring reached force enough to rotate the drive cam.

Patent Document 1: JP-A-2002-227753
Patent Document 2: JP-A-2002-235640
Patent Document 3: JP-A-2002-285940

DISCLOSURE OF THE INVENTION

Problems that the Invention is to Solve

The starter rope wound on the rope reel, however, must have a length necessary for storage of enough force in the force storage spiral spring when the whole length of the starter rope was pulled completely. Moreover, even when the starter rope was pulled, the engine could not start unless enough force was stored in the force storage spiral spring.

Moreover, in the starter according to the background art, in the configuration that the drive cam, the drive gear and the rope reel were disposed coaxially while the force storage spiral spring was wound between the drive cam and the drive gear, the drive cam, the drive gear, the rope reel and the force storage spiral spring could not but be supported onto a slender shaft which was provided so as to be integrated with a starter casing and with which the drive cam, the drive gear, the rope reel and the force storage spiral spring were skewered so as to overlap one another. For this reason, it was difficult to obtain accuracy of concentricity because the shaft could not bear with the load of these parts so that the support was apt to vary unstably. There was a problem that contact and abnormal noise occurred and malfunction occurred easily. Such a phenomenon appears more remarkably under the action of a pressure angle particularly in the case of gear driving by means of the starter motor.

To eliminate the aforementioned disadvantage, for example, Patent Document 1 disclosed a measure that a part of the drive cam was supported by the starter casing but it could not be said that the measure was sufficient.

In order to solve the aforementioned problems, an object of the present invention is to provide a starter for a small-sized engine, in which engine start using a rope reel can be made surely while a drive cam can be supported stably.

Means for Solving the Problems

To solve the aforementioned problems, the invention according to claim 1 provides a starter for a small-sized engine, wherein a cylindrical drive cam provided with a starter clutch mechanism capable of being operably connected to the engine, a recoil starter rope reel wound with a starter rope and disposed so as to be coaxial with the drive cam, and a starter motor are provided in a starter casing so that the drive cam is made capable of being selectively operably connected to the rope reel or to the starter motor, the starter for the small-sized engine characterized in that: the rope reel and the drive cam are directly operably connected to each other by a one-way clutch mechanism; and support plates are formed so as to protrude from an inner surface of the starter casing toward an outer circumferential surface of the drive cam so that opposite end portions of the drive cam are rotatably supportedly fitted into bearing holes formed in the support plates respectively.

Effect of the Invention

Since the invention according to Claim 1 is configured so that rotation of the rope reel is directly transmitted to the drive cam, the drive cam rotates at a high rotational speed soon after the rope reel is pulled, compared with the background-art configuration that rotation of the rope reel is transmitted to the drive cam through the force storage spiral spring. Accordingly, the engine can be started surely.

Since the configuration that rotation of the rope reel is directly transmitted to the drive cam has no relation with a rotation transmission system from the motor side to the drive cam, support plates can be formed in the starter casing so that the support plates support the rope reel.

Since configuration is made so that opposite end portions of the drive cam are rotatably supported into bearing holes formed in the two support plates integrated with the inner surface of the starter casing, external force to move the drive cam in a direction perpendicular to the axial direction thereof acts in directions of plate surfaces of the support plates even when the drive cam suffers the external force. Accordingly, the drive cam can rotate smoothly while supported sufficiently stably.

BEST MODE FOR CARRYING OUT THE INVENTION

Embodiments of the present invention will be described below with reference to the drawings. FIG. 1 is a vertical sectional view of a starter for a small-sized engine. The starter has a combination of a recoil starter for pulling a starter rope 2 wound on a rope reel 1 and a starter motor 3 electrically operated. A pulley 5 fixed on a crank shaft of the engine is attached to a front side of a starter casing 4. A cylindrical drive cam 7 capable of being fitted to the pulley 5 is rotatably disposed in the starter casing 4 so as to be coaxial with the pulley 5.

The drive cam 7 is formed cylindrically. In the driven cam 7, a flange 7*b* is formed in an intermediate portion of a cylindrical portion 7*a* so as to overhang and is disposed substantially in the center of the starter casing 4. Front and rear support plates 6*a* and 6*b* the number of which is two (or may be more than two) are formed in parallel with each other so as to protrude from the inner surface of the starter casing 4 toward the outer circumferential surface of the drive cam 7 and make a right angle with the outer circumferential surface of the drive cam 7. Front and rear end portions of the cylindrical portion 7*a* of the drive cam 7 are rotatably supportedly fitted into short-cylinder-shaped bearing holes 8 which are formed in the support plates 6*a* and 6*b* respectively. The flange 7*b* is disposed between the support plates 6. Further, a space portion is formed between the flange 7*b* and the rear support plate 6*b*. A cam pawl 10 is formed at a front end of the cylindrical portion 7*a* of the drive cam 7 so that the cam pawl 10 is detachably fitted to a centrifugal ratchet 9 provided in a side surface of the pulley 5. The centrifugal ratchet 9 is urged by a spring to be always engaged with the cam pawl 10 of the drive cam 7 to thereby provide a starter clutch mechanism.

In the same manner as disclosed in FIG. 4 of Patent Document 1, configuration is made so that the pulley 5 rotates because the centrifugal ratchet 9 engages with the cam pawl 10 when the drive cam 7 rotates in one direction, whereas the pulley 5 does not rotate because the drive cam idles when the drive cam rotates in the other direction. Configuration is made so that when the pulley 5 rotates and the engine rotates so that the pulley 5 is rotated by the engine, the centrifugal ratchet 9 rotates in a direction of disconnection from the cam pawl by centrifugal force to cut off transmission of rotation between the engine side and the drive cam 7 side.

Next, both motor start and recoil start are configured so that the drive cam 7 is rotated.

First, the rotation transmission mechanism based on the starter motor 3 to the drive cam 7 is composed of three reduction gears 13, 14 and 15. That is, the first reduction gear 13 engages with a gear 17 of an output shaft 16 of the starter motor 3 (driven by a battery), the second reduction gear 14 engages with a small-diameter gear portion 13*a* of the first reduction gear 13, and a small-diameter gear portion 14*a* of the second reduction gear 14 engages with a gear 15*a* of the last reduction gear 15. A bearing hole 18 formed in the center of the last reduction gear 15 is rotatably fitted to the drive cam 7. A damper spring 19 is wound between the drive cam 7 and the last reduction gear 15. An outer end of the damper spring 19 is attached to the last reduction gear 15. As shown in FIG. 2, an inner end 19*a* of the damper spring 19 can be fitted to a step portion 20 formed in the outside of the cylindrical portion 7*a* of the drive cam 7.

Incidentally, the last reduction gear 15 and the damper spring 19 are contained in a space portion formed between the flange 7*b* of the drive cam 7 and the rear support plate 6*b* and are rotatably supported onto the cylindrical portion 7*a* of the drive cam 7. The last reduction gear 15 is fitted to the rear support plate 6*b* so as to be prevented from dropping out.

In the aforementioned configuration, for start at the starter motor 3, electric power from a battery is supplied to the starter motor 3. Accordingly, rotating force thereof is transmitted from the gear 17 fixed onto the output shaft 16 to the last reduction gear 15 via the first and second reduction gears 13 and 14, so that the last reduction gear 15 rotates. The cam pawl 10 of the drive cam 7 is urged to be always fitted to the centrifugal ratchet 9 of the pulley 5. Thus, when the last reduction gear 15 rotates, the load imposed on the drive cam 7 increases in accordance with an increase in rotating load due to starting resistance of the engine so that the damper spring 19 is wound up. When the damper spring 19 is wound up, the rotating force is stored in the damper spring 19. When the stored force reaches a predetermined amount or more, the drive cam 7 bursts out rotating. The pulley 5 rotates in accordance with the rotation of the drive cam 7 in one direction, so that the engine connected to the pulley 5 starts.

In this manner, the drive cam 7 rotates as described above in motor starting but the rotating force thereof is not transmitted to the rope reel 1 because the rope reel 1 is disconnected from the drive cam 7. Further, necessary energy is stored in the damper spring 19 surely because the last reduction gear 15 rotates continuously as long as the starter motor 3 operates.

Next, the rotation transmission mechanism based on recoil start is configured as follows. That is, a shaft 21 is formed so as to protrude from a rear plate 4*a* of the starter casing 4. The rope reel 1 is supported onto the shaft 21 so that the rope reel 1 can rotate coaxially with the drive cam 7. The rope reel 1 has a rope storage groove 23 in the outside of a bearing hole 22 formed in the center of the rope reel 1. The rope storage groove 23 is wound with the starter rope 2 which has one end led out of the starter casing 4, and a base end fixed to the rope reel 1 so as not to drop out. By pulling the aforementioned one end, the starter rope 2 is led out of the rope reel 1 so that the rope reel 1 is driven to rotate on the reel shaft 21.

Incidentally, a spiral spring 24 for returning the rotation of the rope reel 1 is disposed in the rear of the rope reel 1. The spiral spring 24 has one end engaged with the outside of the bearing hole 22 of the rope reel 1, and the other end engaged with the inside of the starter casing 4.

A one-way clutch mechanism 30 is provided between the drive cam 7 and the rope reel 1. That is, a spiral spline 25 is formed in a circumferential surface of an inner circumferential side recess of the rope storage portion 23 of the rope reel 1, whereas a spiral spline 25 which engages with the spiral spline 25 is formed also in an outer circumference of a clutch cylinder 26 which is disposed so as to be axially slidably fitted into the inside of the rope reel 1. The clutch cylinder 26 is mounted so as to be fitted to a friction spring 27 wound on the shaft 21 to thereby be prevented from rotating. A ratchet pawl 28 is formed at a front end. The clutch cylinder 26 is formed so as to be equal to or smaller than the bearing holes 8 of the support plates 6*a* and 6*b*.

On the other hand, an engagement portion 28 which can engage with the engagement cylinder 26 is formed at a rope reel 1 side end portion of the cylindrical portion 7*a* of the drive cam 7.

In the aforementioned configuration, when the starter rope 2 is pulled for recoil start, the bearing hole 22 rotates together with the rope reel 1 but the clutch cylinder 26 engaging with the spline 25 in the outer circumference of the clutch cylinder 26 protrudes out so as to engage with the ratchet pawl 28 of the cylindrical portion 7*a* of the drive cam 7 because the clutch cylinder 26 is urged not to rotate. Therefore, the drive cam 7 rotates directly, the pulley 5 rotates in accordance with the rotation of the drive cam 7, and the engine connected to the pulley 5 starts.

Incidentally, the one-way clutch mechanism 30 is a well-known mechanism shown in JP-B-2-5913.

As described above, since configuration is made so that the rotation of the rope reel is directly transmitted to the drive cam 7 without interposition of such a drive gear as in the background art, the drive cam 7 rotates at a high rotational speed soon after the rope reel is pulled, compared with the background-art case where the rotation of the rope reel 1 is transmitted to the drive cam 7 through a damper spring 19. Accordingly, the engine can be started surely.

Incidentally, when the drive cam 7 rotates as shown in FIG. 2, the inner end 19*a* of the damper spring 19 is not fitted to the step portion 20 of the cylindrical portion 7*a* so that the damper spring 19 is not wound up. Only the drive cam 7 rotates. Accordingly, the rotating force of the drive cam 7 is not transmitted to the last reduction gear.

Incidentally, when the pulley 5 is rotated by the started engine, the centrifugal ratchet 9 rotates in a direction of disconnection from the cam pawl 10 by centrifugal force according to the rotation of the pulley 5 to thereby cut off rotation transmission between the engine side and the drive cam 7 side.

As described above, the engine is started selectively either by starter motor 3 start or by recoil start.

Even when the drive cam 7 suffers external force to be moved in a direction perpendicular to the axial direction thereof, the external force acts in directions of plate surfaces of the support plates 6*a* and 6*b* because the opposite end portions of the drive cam 7 are rotatably supportedly fitted into the bearing holes 22 of the two, front and rear support plates 6*a* and 6*b* which are formed so as to be integrated with the inner surface of the starter casing 4. Accordingly, the drive cam 7 can be supported sufficiently stably and can rotate smoothly compared with the background-art configuration that the drive cam 7 is supported to a slender unstable shaft.

In connection with this, the engagement cylinder 26 is formed so as to be equal to or smaller than the bearing holes 8 of the support plates 6*a* and 6*b*. Thus, the engagement cylinder 26 does not interfere with the support plate 6*b* supporting the drive cam 7 so that the drive cam 7 can be supported by the support plates 6*a* and 6*b* reasonably. Since configuration is made so that only the rope reel 1 is supported on the shaft 21 of the starter casing 4, the distance between the drive cam 7 and the rope reel 1 can be widened so that there can be an enough space for the support plate 6*b* of the drive cam 7 to be formed in the starter casing 4. The configuration that the rotation of the rope reel 1 is directly transmitted to the drive cam 7 has no relation with a rotation transmission system from the starter motor side to the drive cam 7 so that it is unnecessary to transmit the rotation between the rope reel 1 and the last reduction gear 15. Thus, the support plate 6*b* supporting the rear portion of the rope reel 1 can be formed and any shape such as a hollow shape can be taken as the shape thereof without limitation to the form shown in the drawings.

Incidentally, the one-way clutch mechanism between the drive cam 7 and the rope reel 1 is not limited to one shown in FIG. 1. For example, as shown in FIGS. 3 and 4, configuration may be made in such a manner that an extension cylindrical portion 31 is formed on a side opposite to the bearing hole 22 formed in the center of the rope reel 1 so that the extension cylindrical portion 31 is fitted into the inside of the cylindrical portion 7*a* of the drive cam 7, and each needle bearing 33 is disposed in the inside of each groove 32 which is provided in the inner surface of the cylindrical portion 7*a* and which is formed deeply in one end and gently slopes from the one end to the other end. When the rope reel 1 rotates in a direction A, the drive cam 7 also rotates because the needle bearing 33 moves to the shallow portion of the groove 32 so that the needle bearing 33 is interposed between the extension cylindrical portion 31 of the rope reel 1 and the cylindrical portion 7*a* of the drive cam 7 to thereby increase resistance. When the rope reel 1 rotates in a direction B, the drive cam 7 does not rotate because the needle bearing 33 runs away to the deep portion of the groove 32. Of course, another one-way clutch mechanism may be used.

DESCRIPTION OF REFERENCE NUMERALS

Figure 1:
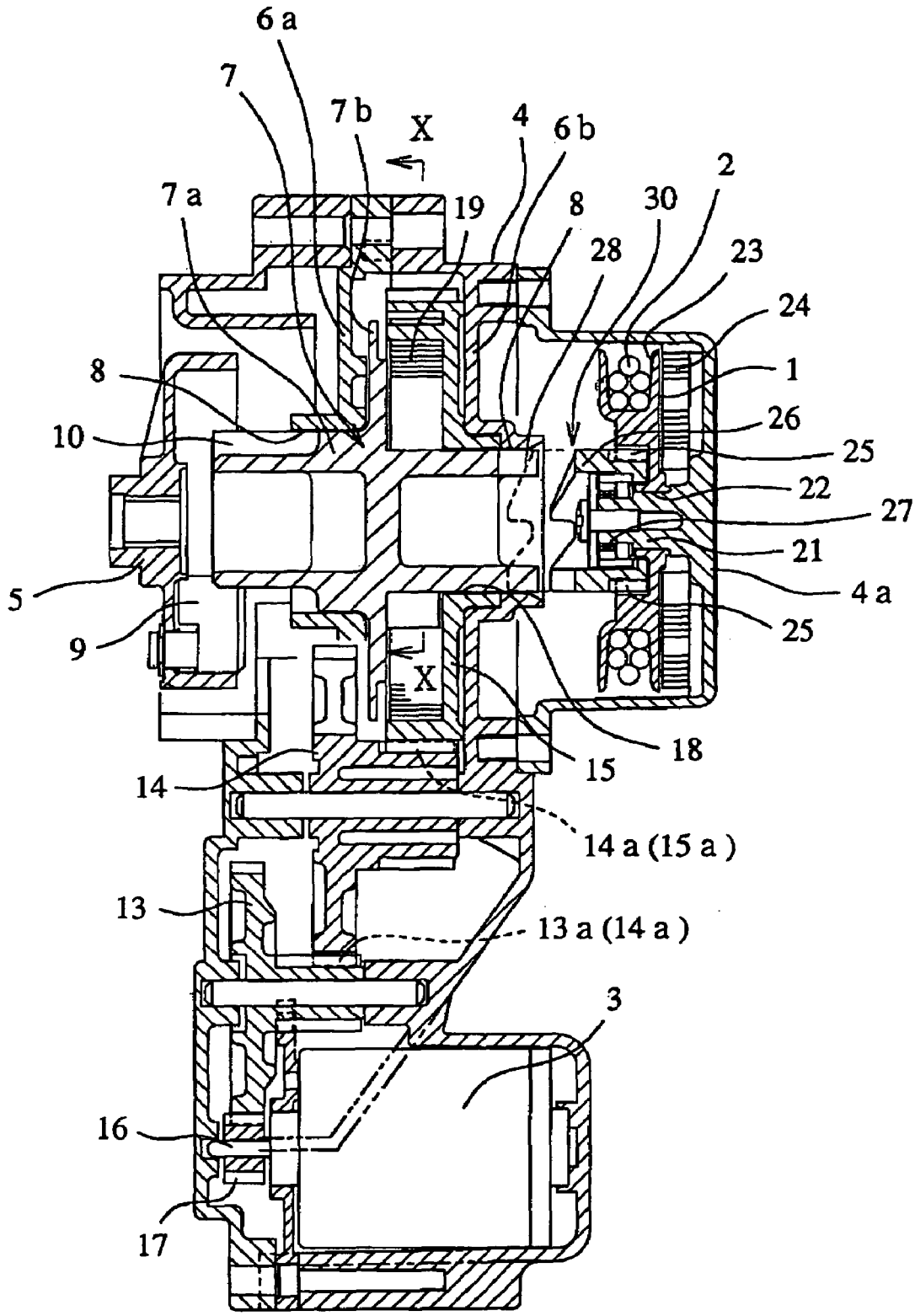
FIG. 1 A vertical sectional view of a starter according to the present invention.
Figure 2:
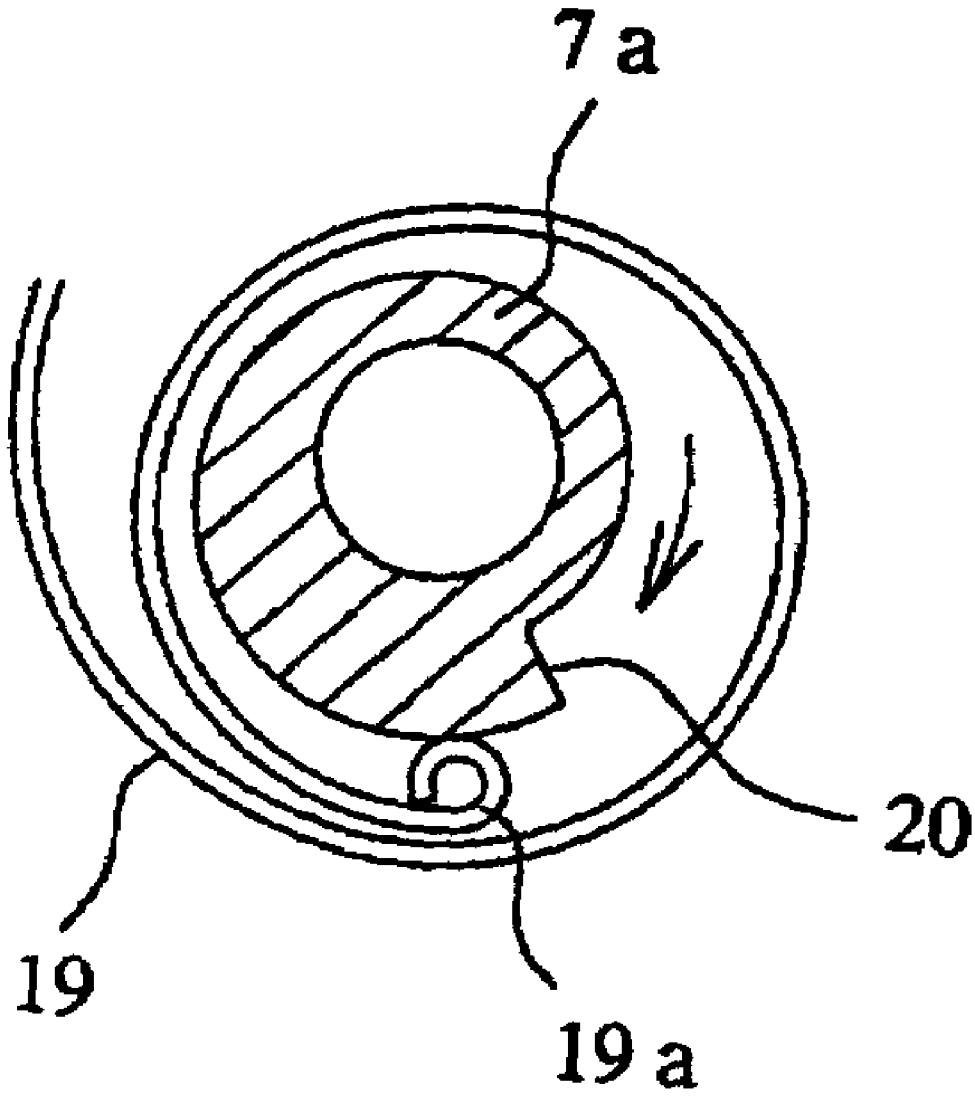
FIG. 2 An explanatory view showing important part of a section taken on the line X-X in FIG. 1.
Figure 3:
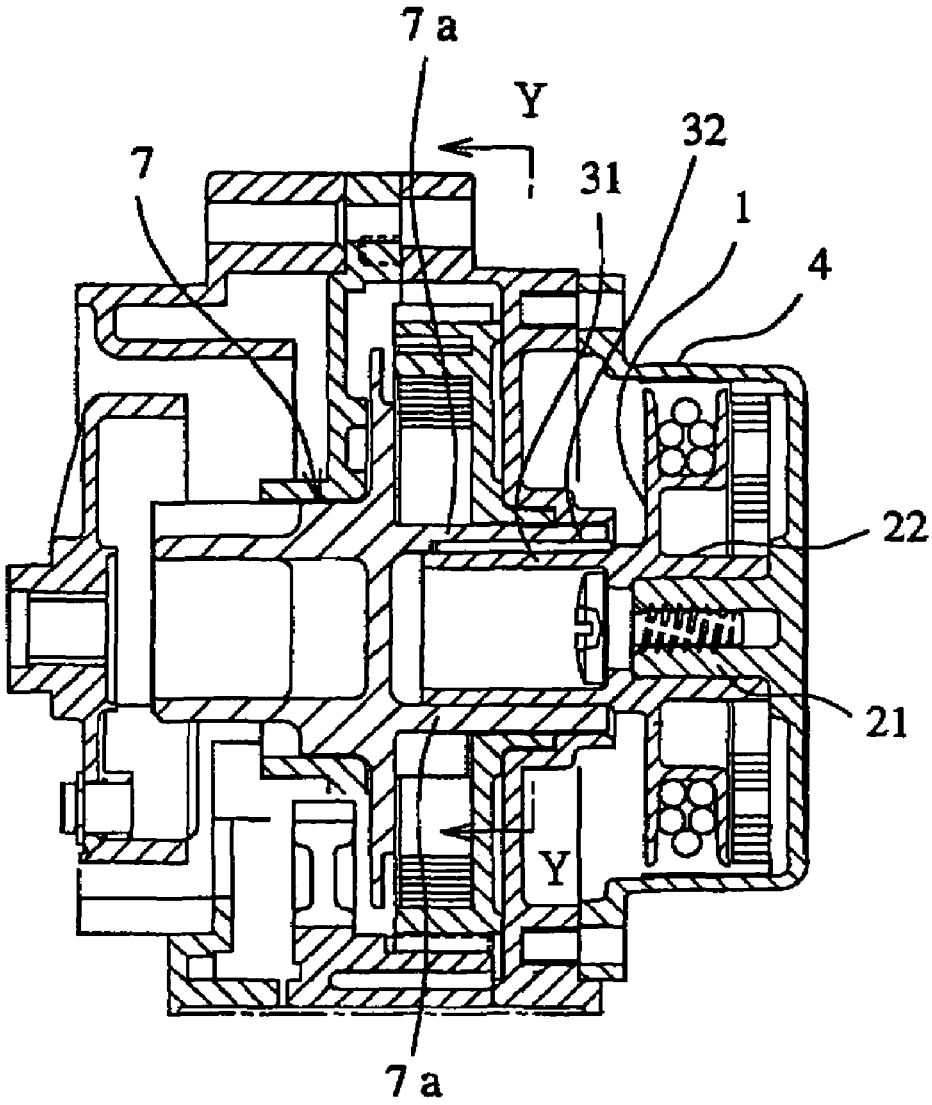
FIG. 3 A vertical sectional view of part of another embodiment.
Figure 4:
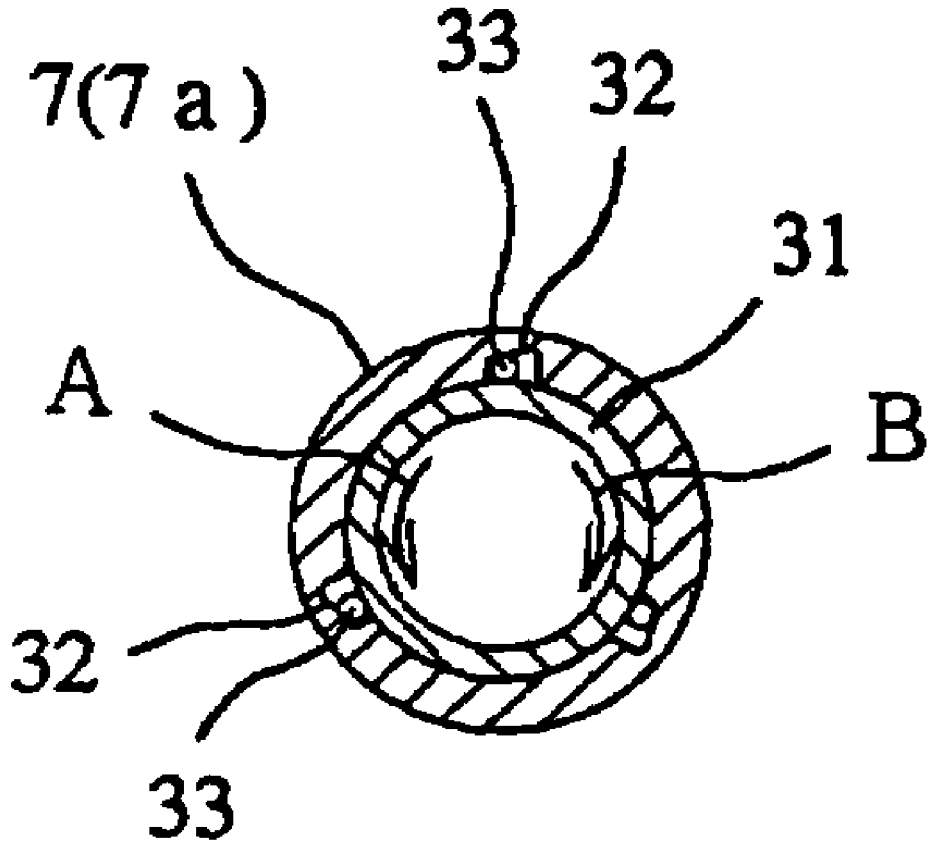
FIG. 4 An explanatory view showing important part of a section taken along the line Y-Y in FIG. 3.

1 rope reel
3 starter motor
4 starter casing
6*a*, 6*b* support plate
7 drive cam

The invention claimed is:

1. A starter for a small-sized engine, wherein a cylindrical drive cam provided with a starter clutch mechanism capable of being operably connected to the engine, a recoil starter rope reel wound with a starter rope and disposed so as to be coaxial with the drive cam, and a starter motor are provided in a starter casing so that the drive cam is made capable of being selectively operably connected to the rope reel or to the starter motor, the starter for the small-sized engine characterized in that:

the rope reel and the drive cam are directly operably connected to each other by a one-way clutch mechanism; and support plates are formed so as to protrude from an inner surface of the starter casing toward an outer circumferential surface of the drive cam so that opposite end portions of the drive cam are rotatably supportedly fitted into bearing holes formed in the support plates respectively.

* * * * *